US010081484B2

(12) United States Patent
Pilzecker

(10) Patent No.: US 10,081,484 B2
(45) Date of Patent: Sep. 25, 2018

(54) EASY OPENING RECLOSE SYSTEMS FOR CIGARETTE PACKAGING

(71) Applicant: Amcor Flexibles, Kreuzlingen (CH)

(72) Inventor: Jens Pilzecker, Bückeburg (DE)

(73) Assignee: Amcor Flexibles, Kreuzlingen (CH)

( * ) Notice: Subject to any disclaimer, the term of this patent is extended or adjusted under 35 U.S.C. 154(b) by 392 days.

(21) Appl. No.: 14/769,401

(22) PCT Filed: Feb. 12, 2014

(86) PCT No.: PCT/EP2014/052699
§ 371 (c)(1),
(2) Date: Aug. 20, 2015

(87) PCT Pub. No.: WO2014/128037
PCT Pub. Date: Aug. 28, 2014

(65) Prior Publication Data

US 2015/0375923 A1 Dec. 31, 2015

(30) Foreign Application Priority Data

Feb. 22, 2013 (EP) ..... 13156415

(51) Int. Cl.
*B65D 85/10* (2006.01)
*B65D 75/58* (2006.01)
(Continued)

(52) U.S. Cl.
CPC ..... *B65D 85/1045* (2013.01); *A24F 15/00* (2013.01); *B65D 65/14* (2013.01);
(Continued)

(58) Field of Classification Search
CPC . B65D 65/14; B65D 85/1018; B65D 85/1045
(Continued)

(56) References Cited

U.S. PATENT DOCUMENTS 4,260,061 A * 4/1981 Jacobs ..... B65D 75/5833 383/203
4,610,357 A 9/1986 Nakamura
(Continued)

FOREIGN PATENT DOCUMENTS

EP 1449789 A1 8/2004
WO WO 98/22367 A1 5/1998
(Continued)

*Primary Examiner* — Luan K Bui
(74) *Attorney, Agent, or Firm* — Reinhart Boerner Van Deuren P.C.

(57) ABSTRACT

The present invention is related to a reclosable pack (1) of smoking articles (2), said pack comprising a sealed enclosure having a front wall, a back wall, two side walls (7), a top-end wall (8) and a bottom-end wall (6), said enclosure comprising a flexible packaging laminate around a bundle of smoking articles (2), the laminate having a built-in easy-opening access comprising a permanently tacky adhesive (3) sandwiched between two film structures, said structures comprising an outer score line (13) formed through the thickness of the outer layer structure (12) and an inner score line (14) formed through the thickness of the inner layer structure (9), both delimiting separable opening portions, in which a region of the outer opening portion between the outer (13) and inner (14) score lines is attached to an underlying surface of the inner structure via a permanently tacky adhesive (3), the outer opening portion being peelable from the underlying surface of the inner layer structure (9) to build an opening flap (4), and the outer opening portion being re-attachable to the underlying surface of the inner structure (9) via said permanently tacky adhesive for reclosing, in use, the opening access, wherein the permanently tacky adhesive (3), in use, remains located after being peeled on the underlying surface of the inner structure (9) and wherein the permanently tacky adhesive layer (3) is pat-
(Continued)

terned and located on the surface delimited by the outer score line (13) and the inner score line (14).

17 Claims, 4 Drawing Sheets

(51) Int. Cl.
*A24F 15/00* (2006.01)
*B65D 65/14* (2006.01)

(52) U.S. Cl.
CPC ..... *B65D 75/5833* (2013.01); *B65D 85/1018* (2013.01); *B65D 2575/586* (2013.01)

(58) Field of Classification Search
USPC ..... 206/245, 265, 268, 271, 273; 156/272.8, 156/324.4; 229/160.1, 87.14
See application file for complete search history.

(56) References Cited

U.S. PATENT DOCUMENTS 4,807,745 A * 2/1989 Langley ..... B32B 27/40 206/245
6,505,735 B1 * 1/2003 Parker ..... B65D 75/5838 206/265
2005/0276525 A1 * 12/2005 Hebert ..... B29C 59/007 383/203
2009/0071852 A1 * 3/2009 Negrini ..... B65D 85/10 206/268
2011/0114518 A1 * 5/2011 Hein ..... B65B 19/20 206/268
2012/0111746 A1 * 5/2012 Tanbo ..... B65D 77/02 206/268
2014/0110286 A1 * 4/2014 Bertuzzi ..... B65D 75/5894 206/268

FOREIGN PATENT DOCUMENTS

WO WO 00/03937 A1 1/2000
WO WO 01/89962 A1 11/2001
WO WO 02/066341 A1 8/2002
WO WO 2005/123535 A1 12/2005
WO WO 2008/062159 A1 5/2008
WO WO 2008/115693 A1 9/2008
WO WO 2011/009520 A1 1/2011
WO WO 2011/110272 A1 9/2011

* cited by examiner

EASY OPENING RECLOSE SYSTEMS FOR CIGARETTE PACKAGING

FIELD OF THE INVENTION

The present invention is related to an easy opening and reclose system for cigarette packs, in particular for inner liner of rigid cigarette boxes or for cigarette packs of flexible films called soft packs.

STATE OF THE ART

Numerous opening and reclose systems for inner liner of cigarette boxes or cigarette soft packs exist today on the market. Documents related to such systems are notably WO 2011/089962 A1 (BAT), WO 2008/062159 A1 (BAT) and WO 2011/110272 A1 (Focke).

WO 98/22367 A1 (BAT) discloses a soft pack of smoking articles with inner stiffening frame comprising a sealed enclosure of a barrier layer around a bundle of smoking articles, an aperture in the top-end wall of barrier layer, a cover layer over the aperture with a permanently tacky undersurface to reseal the aperture by the application of said undersurface on the barrier layer and a frame inside the enclosure and over the bundle of smoking articles at the top edges of the frame providing reaction surfaces against resealing pressure applied when closing the cover layer over the aperture.

WO 2001/089962 A1 (BAT) discloses a soft pack with no inner stiffening frame and a sealed enclosure of a barrier material with an aperture that is reclosable with a re-sealable cover layer having a pull tab. A sheet-material wrap is disposed exteriorly of said enclosure and over the cover layer. For the first opening of the aperture, the wrap needs to be torn or removed.

Laminates and methods for the production of said laminates suitable for the manufacturing of the above mentioned packs are mentioned in WO 2008/115693 A1 (Wrigley), WO 2008/115693 A1 (Wrigley), WO 2005/123535 A1 (Sonoco), WO 02/066341 (BAT), EP 1 449 789 (Alcan) and U.S. Pat. No. 4,610,357 (Nakamura).

These documents disclose flexible packaging laminates having a built-in opening and reclose feature, generally comprising a permanently tacky adhesive or a permanently tacky label to reclose the pack. A peripheral tacky region is generally attached to an underlying surface, the outer opening portion generally being peelable from an underlying surface. The opening access extends over the top-end wall and the front wall of the cigarette.

Each of the above mentioned packaging's and laminates has its specific advantages and drawbacks and there is still a need for improvement of the easy opening and reclose systems of cigarette packs.

AIM OF THE INVENTION

The present invention aims to provide an easy opening and reclose system for cigarette packs with a specific opening access at the top and front end of the pack, and in particular a built-in easy-opening access obtained by the use of a specific laminate comprising specifically-positioned score lines that are able to generate a flap with a permanently tacky adhesive on its periphery remaining located on the underlying surface after the flap is peeled off.

SUMMARY OF THE INVENTION

The present invention discloses a reclosable pack of smoking articles, said pack comprising a sealed enclosure having a front wall, a back wall, two side walls, a top-end wall and a bottom-end wall, said enclosure comprising a flexible packaging laminate around a bundle of smoking articles, the laminate having a built-in easy-opening access comprising a permanently tacky adhesive sandwiched between two film structures, said structures comprising an outer score line formed through the thickness of the outer layer structure and an inner score line formed through the thickness of the inner layer structure, both delimiting separable opening portions, in which a region of the outer opening portion between the outer and inner score lines is attached to an underlying surface of the inner structure via a permanently tacky adhesive, the outer opening portion being peelable from the underlying surface of the inner layer structure to build an opening flap, and the outer opening portion being re-attachable to the underlying surface of the inner structure via said permanently tacky adhesive for reclosing, in use, the opening access wherein the permanently tacky adhesive, in use, remains located after being peeled on the underlying surface of the inner structure.

Preferred embodiments of the present invention disclose at least one, or an appropriate combination of the following features:

- the opening access is exclusively located at the top-end wall of the sealed enclosure;
- the permanently tacky adhesive layer is patterned and located on the surface delimited by the outer score line and the inner score line;
- the flexible packaging laminate comprises a layer of a permanent adhesive extending over the entire surface of the laminate;
- the flexible packaging laminate comprises a release layer between the patterned, permanently tacky adhesive layer and the permanent adhesive;
- the release layer extends over the entire surface of the laminate;
- the flexible packaging laminate further comprises an opaque layer located between the inner structure and the outer structure, the depth of the first and second scoring lines being limited by said opaque layer;
- the opaque layer is the release layer, the permanent laminating adhesive layer, an aluminium layer or a printed layer;
- the adhesion at 20° C. between the permanently tacky adhesive layer and said enclosure is comprised between 1 and 10 N/15 mm, preferably between 1 and 5N/15 mm, and most preferably between 2 and 3 N/15 mm according to test method FINAT No 2;
- the adhesion at 20° C. between of the permanently tacky adhesive layer and the inner structure is at least 2 N/15 mm stronger than the adhesion between the permanently tacky adhesive layer and the outer structure;
- the sealed enclosure is an inner liner of a carton box.

The present invention also discloses a method for the production of the reclosable pack according to the invention, comprising the steps of:

- applying a predetermined pattern of a permanently tacky adhesive onto one surface of a first structure comprising at least one layer of flexible material;
- covering at least said predetermined pattern with a protective over-lacquer layer or release layer;
- applying a permanent laminating adhesive across the entire surface of the first structure to cover both the over-lacquer layer and the possible uncovered surface of said first structure;

adhesively joining face-to-face the first structure to a second structure via the permanent adhesive to form a laminate;

forming the built-in open and reclose structure in the flexible packaging laminate, by performing a first and a second offset score line in the first and second structures, respectively to form an integrated flap that can be lifted out of the plane of the laminate to form the opening access;

forming the reclosable pack around a bundle of smoking articles.

Preferred embodiments of the method of the present invention disclose at least one, or an appropriate combination, of the following features:

the over-lacquer layer covers the entire surface of the structure to cover both the permanently tacky adhesive and the first structure;

the over-lacquer layer or release layer is applied in a liquid state, so that the difference of level induced by the patterned permanently tacky adhesive layer is smoothed out by the over-lacquer layer or release layer;

the over lacquer is applied by solvent coating;

the first and the second offset score lines are performed by laser scoring;

the depth of the laser scoring is limited by an opaque layer located between the first and the second structures.

SHORT DESCRIPTION OF THE DRAWINGS

LIST OF REFERENCE SYMBOLS

Figure 1:
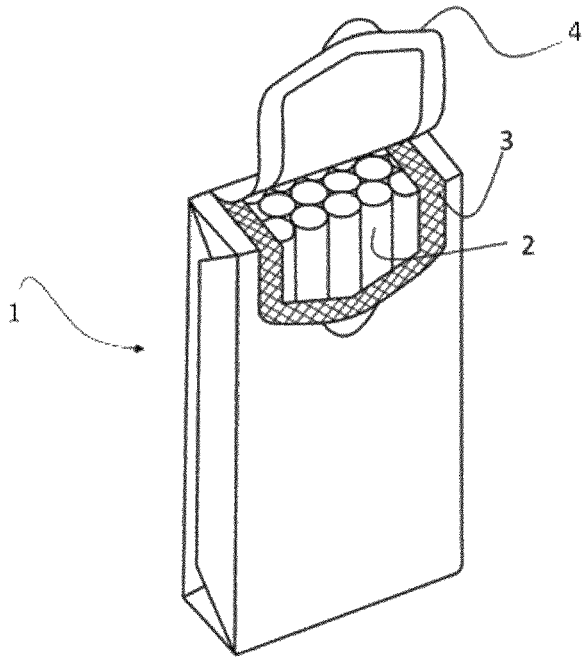
FIG. 1 represents a cigarette packaging comprising a liner with an easy opening and reclose system according to the invention, wherein the inner liner has been opened.

1. Reclosable pack
2. Smoking article
3. Permanently tacky adhesive layer
4. Enclosure flap
5. Carton box
6. Bottom wall
7. Side wall
8. Top wall
9. Inner structure or first structure
10. Over-lacquer or release layer
11. Permanent laminating adhesive
12. Outer structure or second structure
13. Outer score line or second score line
14. Inner score line or first score line

DETAILED DESCRIPTION OF THE INVENTION

Figure 2:
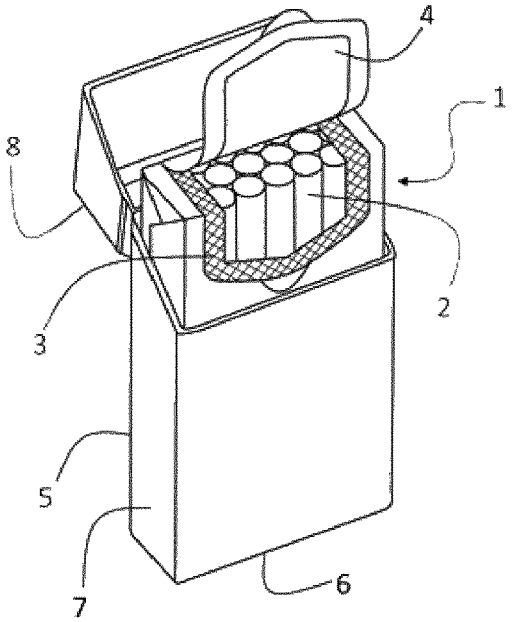
FIG. 2 represents a rigid cigarette box comprising an inner liner with an easy opening and reclose system according to the invention, wherein the inner liner has been opened.
Figure 3:
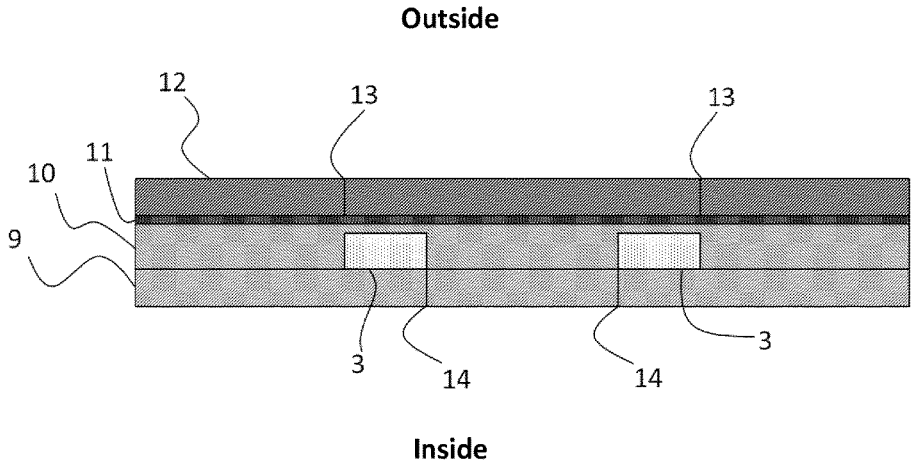
FIG. 3 represents a cross-section of the liner with an easy opening and reclose system in the closed position.
Figure 4:
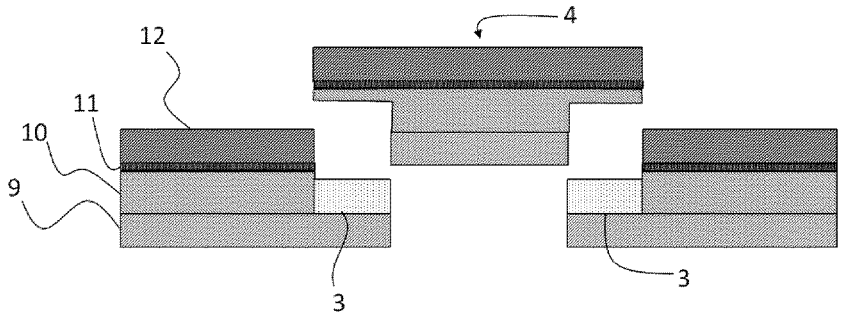
FIG. 4 represents a cross-section of the liner with an easy opening and reclose system in open position after the peel operation with a generated flap.

The present invention is related to a reclosable pack 1 of smoking articles 2, the pack comprising a sealed enclosure comprising a flexible packaging laminate around a bundle of smoking articles 2, the laminate having a built-in easy-opening access. The built-in easy-opening access has in practice the form of an aperture and an enclosure flap 4, the opening comprising on its edges a permanently tacky adhesive (PTA) layer 3, also called pressure-sensitive adhesive. As a general embodiment, the opening access can extend over the top-end wall 8 and the front wall of the reclosable pack 1 (FIGS. 1 & 2).

Figure 5:
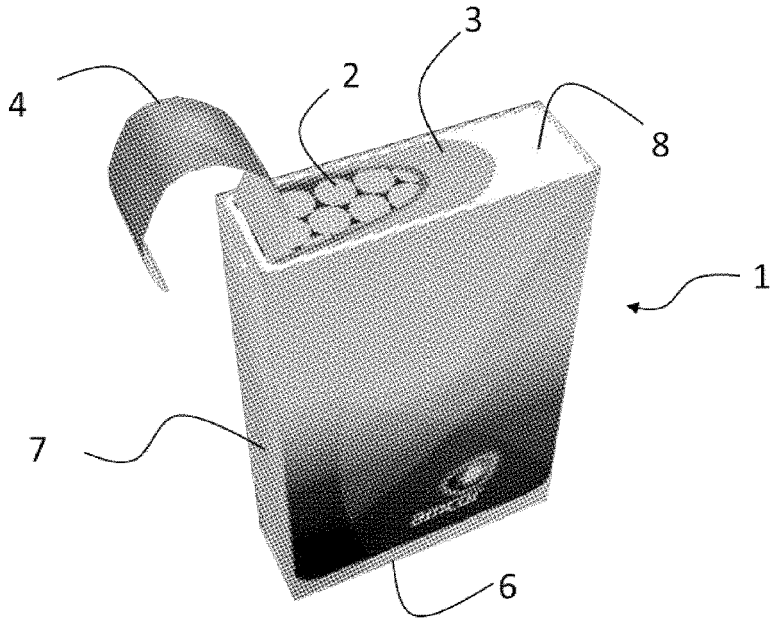
FIG. 5 represents a cigarette packaging according to the invention with an asymmetric opening access exclusively situated on the top of the pack.
Figure 6:
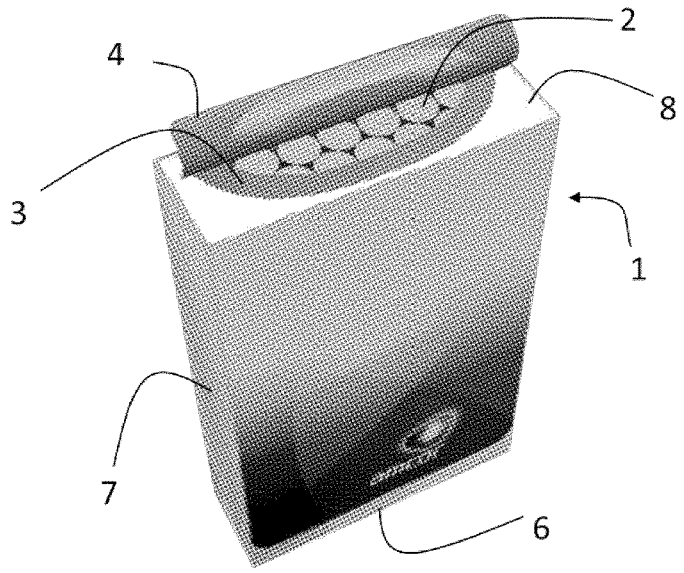
FIG. 6 represents a cigarette packaging according to the invention with a symmetric opening access exclusively situated on the top of the pack.
Figure 7:
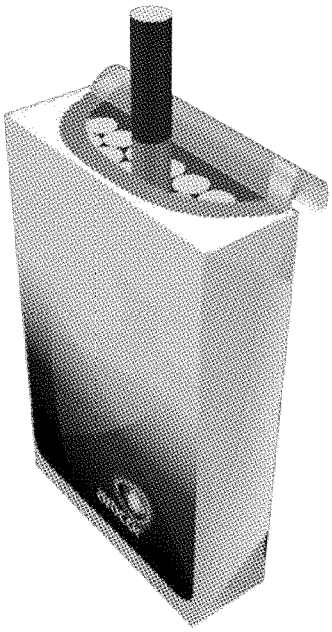
FIG. 7 represents the cigarette packaging of FIG. 6 with a partially-extracted cigarette.

In a particular embodiment, the opening access is exclusively located on the top wall of the reclosable pack 1 as represented in the FIGS. 5 to 7. The location of the permanently tacky adhesive layer 3 on the edges of the aperture prevents that the user, when manipulating the enclosure flap, contaminates the permanently tacky adhesive with his fingers, which would reduce the adhesion, specifically upon multiple reclosing. Furthermore, such location prevents any possible contact between the PTA and the smoking articles 2. Such contact can also potentially contaminate the smoking article 2 with adhesive residue, rendering the smoking article 2 sticky, which can produce an unpleasant contact with the lips of the user.

The flexible packaging laminate used for the reclosable pack 1 of the present invention comprises a first (inner) 9 and second (outer) film structure 12 laminated to one another. On the laminate used in the present invention, we define a first film structure 9 and a second film structure 12. On the reclosable pack, these structures can be called the inner structure 9 and the outer structure 12. Each of the first and second film structures (9, 12) can be a single layer (such as a single polymeric sheet material) or can include two or more layers laminated to one another or even a coextruded multilayer structure. The first and second film structures (9, 12) can further include printed indicia as appropriate for a particular downstream packaging application.

The permanently tacky adhesive (PTA) is preferably pattern-applied (for example in the shape of a U) to a surface of one of the first or second film structures (9, 12). The PTA pattern is then preferably covered with an over-lacquer layer 10. The over-lacquer layer adheres to both the PTA layer 3 and the uncovered surface, and works as a protective or release layer so that the structure with the PTA can be stored on a roll without any blocking effect. Examples of the over-lacquer layer 10 include nitrocellulose materials, nitrocellulose materials mixed with an anti-blocking agent such as silica, and water-based acrylic resins.

The over-lacquer layer 10 can be applied only on the PSA/PTA layer or can advantageously be applied across the entire surface of the structure. In this latter case, the over-lacquer layer 10 preferably has a variable thickness, smoothing out the thickness variability induced by the patterned PTA. For example, the over lacquer 10 is applied in a liquid state by using an appropriate solvent, such as water in the case of water-based acrylic resins.

A layer of permanent adhesive 11 is then applied across the entire surface of the film structure (also referred to as "continuous" or "full" coverage) to cover the PTA, over-lacquer layer (if any) and the possibly uncovered first or second structure. Alternatively, a layer of the permanent adhesive 11 can be applied across the entire surface of any of both structures.

By "permanent adhesive" 11 is meant adhesive that is usually used in lamination process for obtaining permanent adhesion as opposed to peelable adhesive.

The first and second structures (9, 12) are directed into an opposing face-to-face relationship so that the pattern-applied PTA 3, over-lacquer layer 10, and full-coverage permanent adhesive layer 11 are sandwiched between the first and second structures (9, 12). The permanent adhesive 11 adheres to the over-lacquer layer 10 and joins the first and second structures (9, 12) to one another in order to form the flexible packaging laminate.

When the PTA 3 is covered by the over-lacquer layer 10, the first structure 9 with the pattern-applied PTA 3 and over-lacquer layer 10 can be rolled and stored on a roll without blocking effect, and subsequently laminated to a second structure 12 with the permanent adhesive 11 in a separate processing step. Alternatively, the first and second structures (9, 12) with the pattern-applied PTA layer 3, over-lacquer layer 10 and full-coverage permanent adhesive layer 11 can be laminated to one another in an integrated (in-line) process.

To form the built-in open and reclose structure in the flexible packaging laminate according to the invention, a first and a second offset score lines are formed in the first and second structures, respectively to form an integrated flap that can be lifted out of the plane of the laminate to form an opening. The opening allows access to a product enclosed by a package formed of the flexible packaging laminate.

In particular, a first (inner) score line 14 is formed in one of the first or second structures that will form the inner surface of the resulting package (referred to herein as the inner structure). The first score line 14 defines an inner opening surface corresponding to the inner surface of the flap 4 and forms the opening in the laminate when the flap 4 is detached therefrom. The first score line is generally delineated along the inner periphery of the PTA pattern.

A second outer score line 13 offset from the first score line is formed in the other of the first or second structures (9, 12) that will form the outer surface of the resulting package (referred to herein as the outer structure). The second score line defines an outer closing surface corresponding to the outer surface of the flap 4 once it is detached from the laminate. The second score line is generally delineated along the outer periphery of the PTA pattern.

The location of the second score line 13 is selected so that the outer closing surface of the flap 4 includes an edge region extending beyond the outer edge of the underlying inner opening surface of the flap 4. The pattern-applied PTA is accordingly located in the edge region between the first and second score lines (14, 13). The permanent adhesive 11 joins the first and second structures (9, 12) except in this edge region between the first and second score lines (14, 13).

When the flap 4 is lifted out of the plane of the laminate, the inner structure 9 is separated at the first score line 14 and the outer structure 12 is separated at the second score line 13. The permanent adhesive 11 permanently joins the inner opening surface of the inner structure 9 to the outer closing surface of the outer structure 12, lifting the flap 4 forms the opening in the laminate. The flap 4 can be closed by returning it to its original position. The edge region of the outer closing surface of the flap 4 is reattached to an underlying portion of the inner structure 9 via the PTA 3 located in this edge region. The PTA remains on the underlying portion.

The offset score lines (13, 14) are advantageously performed by laser scoring, the depth of the scoring being preferably limited by an opaque layer. The opaque layer can be diffusive of reflective, such as a layer comprising whitening filler such as $TiO_2$ or metallic layer such as an aluminum layer.

Typical film structure to be used in the invention are, from outer to inner layers:

- Outer lacquer/printing layer/OPP 30 μm/permanently tacky adhesive (PTA) 3 μm/permanent adhesive 3 μm/metalized OPP 45 μm
- Outer lacquer/printing layer/OPP 30 μm/permanently tacky adhesive (PTA) 3 μm/release lacquer/permanent adhesive 3 μm/metalized OPP 45 μm
- Outer lacquer/printing layer/PET 18 μm/permanently tacky adhesive (PTA) 3 μm/permanent adhesive 3 μm/metalized PET 18 μm

The invention claimed is:

1. A reclosable pack of smoking articles, said pack comprising a sealed enclosure having a front wall, a back wall, two side walls, a top-end wall and a bottom-end wall, said enclosure comprising a flexible packaging laminate around a bundle of smoking articles, the laminate comprising inner and outer film structures laminated to one another face-to-face via a layer of a permanent adhesive extending over the entire surface of the laminate, the laminate having a built-in easy-opening access comprising a permanently tacky adhesive sandwiched between the inner and outer film structures, said structures comprising an outer score line formed through the thickness of the outer film structure and an inner score line formed through the thickness of the inner film structure, both delimiting separable opening portions, in which a region of an outer opening portion between the outer and inner score lines is attached to an underlying surface of the inner film structure via the permanently tacky adhesive, the outer opening portion being peelable from the underlying surface of the inner film structure to build an opening flap, and the outer opening portion being re-attachable to the underlying surface of the inner film structure via said permanently tacky adhesive for reclosing, in use, the built-in easy-opening access, wherein the permanently tacky adhesive, in use, remains located after being peeled on the underlying surface of the inner film structure and wherein the permanently tacky adhesive is patterned and located on the underlying surface delimited by the outer score line and the inner score line.

2. The pack according to claim 1, wherein said opening access is exclusively located at the top-end wall of the sealed enclosure.

3. The pack according to claim 1, wherein said pack comprises a release layer between the permanently tacky adhesive and the permanent adhesive.

4. The pack according to claim 3, wherein the release layer extends over the entire surface of the laminate.

5. The pack according to claim 4, wherein the flexible packaging laminate further comprises an opaque layer located between the inner film structure and the outer film structure, the depth of the first and second scoring lines being limited by said opaque layer.

6. The pack according to claim 5, wherein the opaque layer is the release layer, the permanent adhesive layer, an aluminium layer or a printed layer.

7. The pack according to claim 1, wherein adhesion at 20° C. of the permanently tacky adhesive with the sealed enclosure is comprised between 1 and 10 N/15 mm according to test method FINAT No 2.

8. The pack according to claim 1, wherein adhesion at 20° C. of the permanently tacky adhesive with the inner film structure is at least 2N/15 mm stronger than adhesion of the permanently tacky adhesive with the outer film structure.

9. The pack according to claim 1, wherein the sealed enclosure is an inner liner of a carton box.

10. The pack according to claim 1, wherein adhesion at 20° C. between the permanently tacky adhesive and the sealed enclosure is comprised between 1 and 5N/15 mm according to test method FINAT No 2.

11. The pack according to claim 1, wherein adhesion at 20° C. between the permanently tacky adhesive and the sealed enclosure is comprised between 2 and 3 N/15 mm according to test method FINAT No 2.

12. A method for the production of the reclosable pack according to claim 1, comprising the steps of:

applying a predetermined pattern of the permanently tacky adhesive onto the underlying surface of the inner film structure comprising at least one layer of flexible material;

covering at least said predetermined pattern with a protective over-lacquer layer or release layer, thereby obtaining the inner film structure;

applying the layer of the permanent adhesive across an entire surface of the first film structure to cover both the over-lacquer layer and the possible uncovered surface of said first film structure;

adhesively joining face-to-face the first film structure to the second film structure via the permanent adhesive so as to form the laminate;

forming the built-in easy-opening access configured to be reclosed in the flexible packaging laminate, by scoring the inner and the outer offset score lines in the inner and outer film structures, respectively to form an integrated flap that can be lifted out of the plane of the laminate to form the easy-opening access;

forming the reclosable pack around the bundle of smoking articles.

13. The method according to claim 12, wherein the over-lacquer layer covers the entire surface of the structure to cover both the permanently tacky adhesive and the inner film structure.

14. The method according to claim 13, wherein the over-lacquer layer or release layer is applied in a liquid state, so that the difference of level induced by the permanently tacky adhesive that is patterned is smoothed out by the over-lacquer layer or release layer.

15. The method according to claim 14, wherein the over lacquer is applied by solvent coating.

16. The method according to claim 12, wherein the first and the second offset score lines are performed by laser scoring.

17. The method according to claim 16, wherein the depth of the laser scoring is limited by an opaque layer located between the first and the second film structures.

* * * * *